United States Patent [19]

Belanger

[11] 4,183,183

[45] * Jan. 15, 1980

[54] PACK UNIT AND MOUNTING MEANS THEREFOR

[75] Inventor: James A. Belanger, Northville, Mich.

[73] Assignee: Belanger, Inc., Northville, Mich.

[ * ] Notice: The portion of the term of this patent subsequent to Apr. 29, 1992, has been disclaimed.

[21] Appl. No.: 888,895

[22] Filed: Mar. 22, 1978

[51] Int. Cl.[2] ..... B24D 13/06

[52] U.S. Cl. ..... 51/334; 51/337; 51/394; 15/230.19

[58] Field of Search ..... 51/331, 332, 334, 335, 51/336, 337, 394; 15/183, 198, 200, 230.14, 230.19

[56] References Cited

U.S. PATENT DOCUMENTS

| | | | |
|---|---|---|---|
| 2,871,632 | 2/1959 | Cosmos | 51/337 |
| 3,058,269 | 10/1962 | Block | 51/337 |
| 3,541,740 | 11/1970 | Radik | 51/332 |
| 3,879,903 | 4/1975 | Belanger | 51/337 |
| 4,055,919 | 11/1977 | Belanger | 51/334 |

FOREIGN PATENT DOCUMENTS

| | | | |
|---|---|---|---|
| 978183 | 4/1951 | France | 51/336 |

*Primary Examiner*—Harold D. Whitehead
*Assistant Examiner*—K. Bradford Adolphson
*Attorney, Agent, or Firm*—Cullen, Sloman, Cantor, Grauer, Scott & Rutherford

[57] ABSTRACT

A pack unit containing fill material is mounted on a hub structure of a rotary finishing wheel having a rotary axis. The pack unit includes a rigid unitary elongated clip member to which the fill material is secured and a flexible plastic unitary elongated link member coextensive in axial length with the clip member and fill material and which includes inner and outer end portions connected by an intermediate flexible solid web portion. The end portions of the link member are provided with enlarged head portions, the inner head portion being adapted to be carried by a slot formation in the hub structure and the outer head portion being received in a mating slot provided in the clip member. When the pack unit is mounted on the hub structure, the flexible web portion of the link member appreciably flexes or bends without stretching or fatiguing when a force is applied to the fill material which swings the clip member and fill material to one side or the other of a radially extending plane containing the rotary axis and the axis of the inner head portion.

14 Claims, 9 Drawing Figures

PACK UNIT AND MOUNTING MEANS THEREFOR

BACKGROUND OF THE INVENTION

1. Field of the Invention

The present invention relates to a pack unit for a rotary finishing wheel, and more particularly to an improved modular pack unit mounting means adapted to flexibly mount pack units having fill material to a hub structure to form a finishing wheel.

The invention finds use in any type of a rotary finishing wheel such as those employing coated abrasive and/or non-abrasive sheets or other fill materials used for grinding, rough or finish working, brushing, burnishing etc. However, in the preferred embodiment of this invention, the pack units are employed in commercial car washing establishments, are replaceably mountable on hub structures, and normally employ cloth, cloth-like material or other suitable fill materials for washing, drying, buffing, polishing, or otherwise finishing the car. Additionally, the pack units of this invention may include other types of conventional finishing or fill material such as sewed sisal, pex, horsehair, leather etc. as is well known in the art.

2. Description of the Prior Art

The closest prior art patent known to me is my U.S. Pat. No. 4,055,919, dated Nov. 1, 1977 entitled "Pack Unit and Mounting Means Therefor". Other of my patents which show prior art rotary finishing wheel structures and pack units are as follows: U.S. Pat. No. 3,455,068, July 15, 1969; No. 3,535,833, Oct. 27, 1970; No. 3,621,622, Nov. 23, 1971; No. 3,626,646, Dec. 14, 1971; No. 3,685,217, Aug. 22, 1972; No. 3,768,214, Oct. 30, 1973; No. 3,772,833, Nov. 20, 1973; No. 3,798,847, Mar. 26, 1974; No. 3,800,481, Apr. 2, 1974; No. 3,807,099, Apr. 30, 1974; No. 3,813,829, June 4, 1974; No. 3,820,291, June 28, 1974; No. 3,842,547, Oct. 22, 1974; No. 3,846,942, Nov. 12, 1974; No. 3,879,903, Apr. 29, 1975; No. 3,914,908, Oct. 28, 1975; and Re. No. 28,118, Aug. 20, 1974. Since these patents teach various rotary finishing wheels, hub structures, and applications for rotary finishing wheels and pack units, they are incorporated herein by reference.

SUMMARY OF THE INVENTION

The modular pack unit of the present invention is relatively inexpensive, easy-to-install, remove, and replace and is adapted to be flexibly mounted to the hub structure of a rotary finishing wheel without the use of insertable rods or complex internal and external clamping mechanisms as shown in the prior art.

The pack unit of the present invention is adapted to be removably mounted on a hub structure for forming a rotary finishing wheel. The hub structure is adapted to be mounted to a shaft for rotation therewith about its rotational axis. The hub structure is provided with a plurality of circumferentially spaced, slot-defining formations about the periphery thereof. These formations define elongated slots each having a longitudinal slot axis parallel to the rotational axis of the hub structure, an interior portion, and a restricted neck passage opening outwardly therefrom.

At least one pack unit is adapted to be mounted in each of the slots of the hub structure. Each pack unit includes at least one, and preferably several, flap-like members of finishing or fill material having a radially outer portion adapted for engaging a workpiece.

The pack unit further includes a unitary, integrally-formed, elongated clip member including a clip body and a pair of radially outwardly extending clamping arms adapted for receiving and securing the radially inner portion of the flap-like members therebetween. The radially inner portion of the clip body is provided with an elongated, radially inwardly disposed slot having an inner portion and a restricted neck passage opening outwardly therefrom. The pack unit also includes a unitary link member made from a flexible plastic material having a first slot-engaging head portion received within the elongated slot of the clip member, a second slot-engaging head portion adapted to be telescopically received within an elongated slot of the hub structure, and a flexible intermediate web portion integrally interconnecting the head portions. The end segments of the intermediate web portion adjacent each head portion is adapted to be telescopically received within the restricted neck passages of the slots so that the link member flexibly mounts the clip body carrying the flap-like members to the hub structure.

When the pack unit is mounted on the hub structure, the flexible web portion appreciably flexes or bends when a force is applied to the clip body and flap-like members. The flexing or bending occurs without any appreciable stretching or fatiguing of the plastic link member. After the fill material or flap-like members have worn, the pack units may be removed from the hub structure and replaced with new pack units.

In the preferred embodiment, the flexible plastic link member has a dumb-bell-shaped cross sectional configuration when viewed along a section taken perpendicular to the rotational axis of the hub structure. The first and second head portions are part-cylindrical in shape and are adapted to be telescopically and matedly received within the part-cylindrical interior portion of the slots provided in the clip body and hub structure. The link member is a single, unitary, integrally-formed, extruded piece of flexible plastic material, and the clip member is a single, unitary, integrally-formed, extruded piece of relatively rigid, light weight material, for example, aluminum, plastic or the like.

Other advantages and meritorious features of the present invention will be more fully understood from the following detailed description of the drawings and the preferred embodiment, the appended claims and the drawings which are described briefly hereinbelow.

DESCRIPTION OF THE PREFERRED EMBODIMENT

Figure 1:
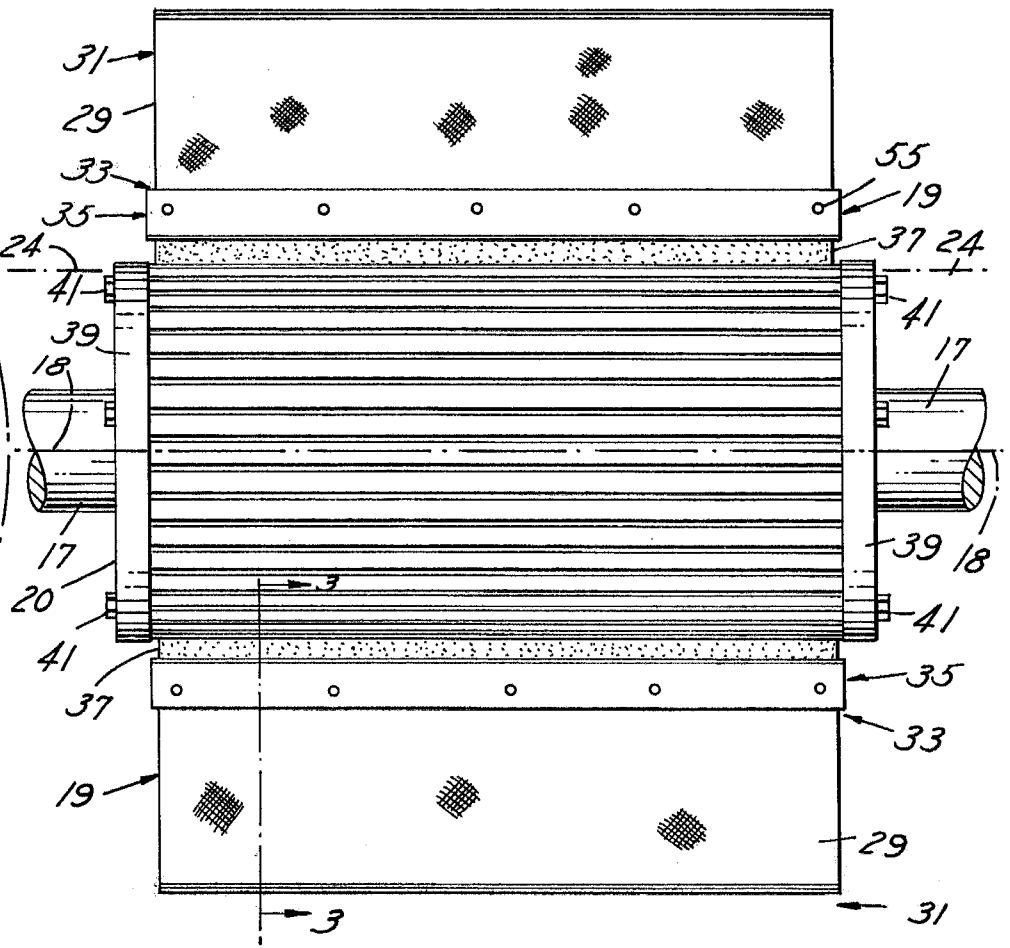
FIG. 1 is a fragmentary top view of the rotary finishing wheel of the present invention.
Figure 2:
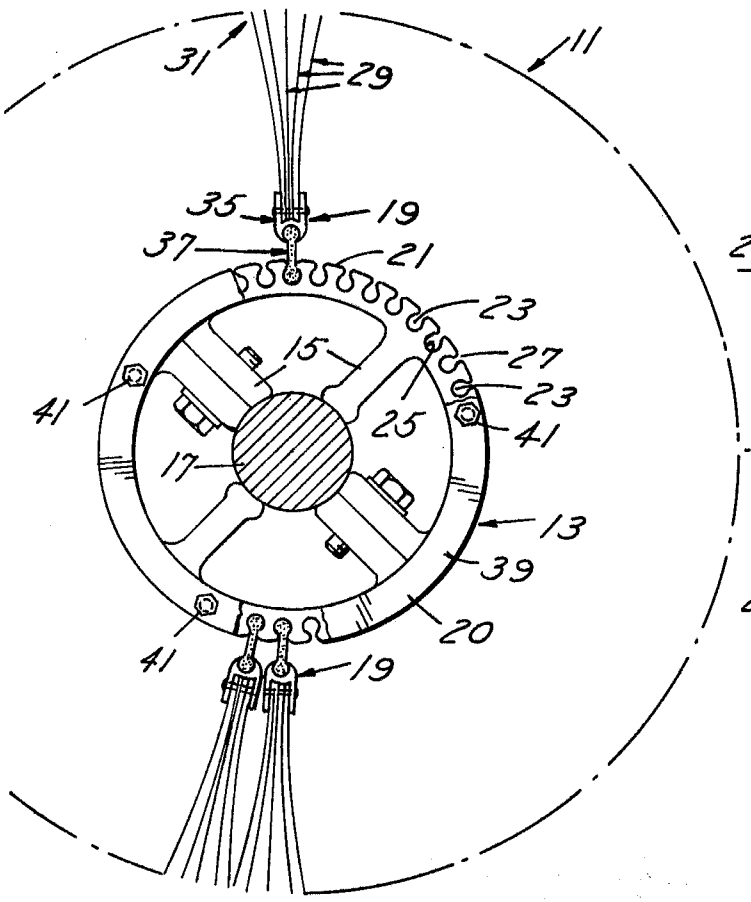
FIG. 2 is a fragmentary axial end view of the rotary finishing wheel of FIG. 1 showing a hub structure secured to a shaft for rotation therewith and slots about the periphery of the hub structure for flexibly mounting the pack units of the present invention.

FIGS. 1 and 2 illustrate a rotary finishing wheel 11 which includes a generally cylindrical hub structure 13 having inner clamping portions 15 adapted to removably secure the hub structure 13 to a shaft 17 for rotation therewith. The rotational axis 18 of the rotary finishing wheel 11 and hub structure 13 is coincident with the rotational axis of the shaft 17. A plurality of replaceable pack units 19 are mounted about the periphery of the hub structure 13 to form the finishing wheel 11.

For a more detailed description of the various hub structures usable with the improved pack units 19 of the present invention, reference is hereby made to my U.S. Pat. No. 4,018,014 dated Apr. 19, 1977 entitled "Hub Structure For Rotary Finishing Wheels". Briefly, the hub structure 13 used to illustrate the present invention includes a generally cylindrical, radially outer hub wall 20 having a plurality of circumferentially spaced, part-cylindrical, key-hole-type, slot-defining formations 21 about the radially outer periphery thereof. The formations 21 define a plurality of longitudinal slots 23, each of which includes a slot axis 24, a part-cylindrical interior portion 25 and a restricted neck passage 27 opening outwardly therefrom. The cylindrical hub wall 20 is removably secured to the shaft 17 by the inner clamping portions 15 which are described more fully in my aforesaid U.S. Pat. No. 4,018,014.

Figure 3:
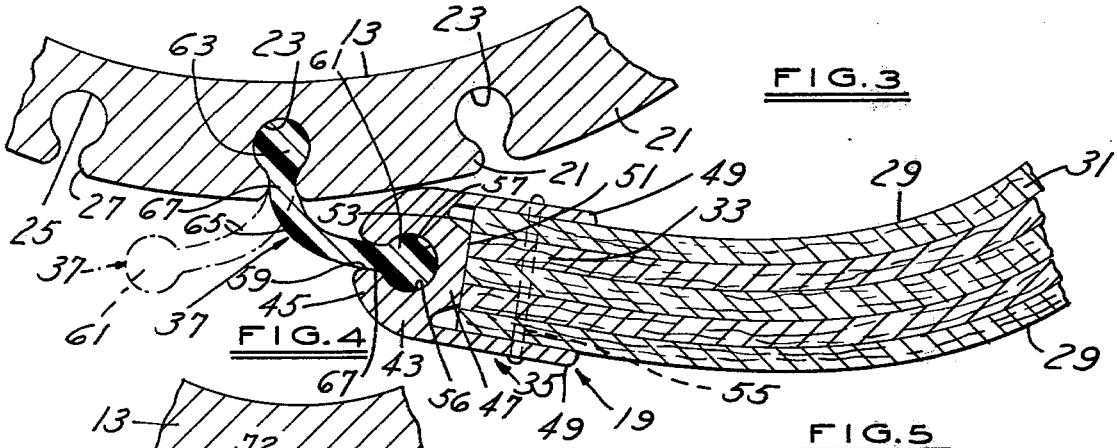
FIG. 3 is a sectional view, taken along lines 3—3 of FIG. 1, of a portion of the hub structure and one of the pack units of the present invention.

As further illustrated in FIGS. 1–3 inclusive, the pack unit 19 of the present invention includes one or more flap-like members 29 of finishing or fill material. Each of the flap-like members 29 includes a radially outer portion 31 adapted for engaging a workpiece and a radially inner portion adapted to be fixedly secured permanently within an elongated clip member 35. The flap-like members 29 may be, for example, sheets or plies of cloth, cloth-like material, felt-like material or the like which are frequently employed in commercial automotive car washing establishments for washing, drying, buffing, polishing, or otherwise finishing a car. Alternatively, the flap-like members 29 may take the form of abrasive sheets or other fill materials which are generally used for grinding, rough or finish working, brushing, burnishing, or the like, and in still other applications, the flap-like members 29 may take the form of sewed sisal, pex, horsehair, leather or the like as is well known in the art. The term "finishing" as used herein is used in a generic sense to refer to any of the types of operations cited above, referred to in my previously identified prior patents or are known in the art.

Each of the pack units 19 includes the elongated clip member 35, which is substantially coextensive in axial length with the elongated slots 23 of the hub structure 13; and a link member 37 made from a flexible plastic material which mounts the clip member 35 to a slot 23 of the hub structure 13 for limited bending or for pivotal movement about the slot axis 24. The slot axes 24 are parallel to the rotational axis 18 and each axis 24 lies in a radially extending plane containing the rotational axis 18. One head portion of the link member 37 is telescopically and slidably received within a hub slot 23 for relative axial motion in a direction parallel to the rotational axis 18 for installing, removing and replacing the pack unit 19. When the pack units 19 are so installed, they are axially retained within the hub slots 23 by means of a pair of end plates 39 which are secured to the ends of the hub structure 13 by bolts 41 or by similar, conventionally-known fastening means.

The pack unit 19 of the present invention will be described in more detail with reference to FIG. 3. The pack unit 19, which includes the flap-like members 29 of finishing material, the elongated clip member 35, and the elongated flexible plastic link member 37 to which the clip member 35 is fixedly secured, represents a modular unit which is easily mounted to and removed from the individual slots 23 of the hub structure 13. Alternatively, the fixedly secured combination of the flap-like members 29 and the elongated clip member 35 can itself be a replaceable modular unit which can be telescopically mounted to and removed from the link member 37 for easy installation, removal, and replacement as shown in my U.S. Pat. No. 4,055,919.

The clip member 35 includes a clip body 43 having a radially inner portion or base 45 and a radially outer portion 47. A pair of clamping arms 49 integral with the radially outer portion 47 of the clip body 43 extend radially outwardly therefrom and are adapted to receive the radially inner portion 33 of the flap-like members 29 therebetween. The central section of the radially outer portion 47 which is disposed between the clamping arms 49 is provided with an abutment surface 51 which abuts the innermost ends 53 of the radially inner portion 33 of the flap-like members 29. When the radially intermost ends 53 of the flap-like members 29 abut the abutment surface 51 and the radially inner portion 33 of the flap-like members 29 are disposed between the pair of clamping arms 49, a plurality of staples 55 or similar fastening means are used to fixedly or permanently secure the pair of clamping arms 49 and the radially inner portions 33 of the flap-like members 29 tightly together in a sandwiched fashion.

The radially inner portion 45 of the clip member 35 is provided with an elongated, part-cylindrical, key-hole-type slot 56 having a quasi-cylindrical interior portion 57 and a restricted neck passage 59 opening outwardly therefrom. The slot 56 is adapted for mounting the fixedly secured combination of the clip member 35 and the flap-like members 29 to the hub structure 17 via the flexible link member 37. The elongated slot 56 of the elongated clip member 35 similarly has a slot axis which is parallel to the rotational axis 18 when the pack unit 19 is mounted on the hub structure 13.

In the preferred embodiment disclosed herein, the elongated clip member 35 is a single, unitary, integrally-formed, extruded piece of relatively rigid, light weight material such as plastic or aluminum. In this embodiment the clip member 35 is substantially coextensive in length with the slots 23 of the hub structure 13.

The link member 37 of the present invention is a single, unitary, solid, integrally-formed, extruded piece of urethane material, for example, a resilient plastic such as No. 355 DH of Mobay Chemical. Such a urethane plastic bends or flexes without fatiguing. The flexible solid link member 37 is generally coextensive in length with the slots 23 of the hub structure 13 and with the combined clip member 35 and flap-like members 29. The cross-sectional configuration of the flexible solid link member 37, taken along a plane perpendicular to the rotational axis 18, is a generally dumb-bell-shaped configuration having a first or inner part-cylindrical head portion 61 adapted to be slidably received within the slot 55 of the elongated clip member 35 for axial movement therein for assembling the clip member 35 in the modular clip member 35 which carries the flap-like members 29. The link member 37 also includes a second or outer part-cylindrical head portion 63 adapted to be slidably received within an elongated slot 23 of the hub structure 13 for axial movement therein to effect the assembly, removal and replacement of the pack unit 19 therefrom. Furthermore, the link member 37 includes an intermediate flexible web portion 65 integrally connecting the first head portion 61 with the second head portion 63. The bending of the pack unit 19 occurs primarily in the web portion or section 65. The intermediate flexible web portion 65 has its end segments 67 which are adjacent to the head portions 61, 63 adapted to be slidably received for axial movement within the restricted neck passages 27, 59 of the slots 23, 55 respectively.

When the improved pack units 19 of the present invention are replaceably mounted on the hub structure 13 to form the finishing wheel 11, the first part-cylindrical head portion 61 of each pack unit 19 is radially constrained within the part-cylindrical interior portion 57 of the clip member slot 55 by the restricted neck passage 59 and the second part-cylindrical head portion 63 is radially constrained within the part-cylindrical interior portion 25 of the hub slot 23 by the restricted neck passage 27 thereby allowing the intermediate web portion 65, which extends radially outwardly through the restricted neck passages 27, 59, to interconnect the head portions 63, 61 respectively, thereby mounting the pack unit 19 to the hub structure 13 to permit the clip member 35 and flap-like members 29 to swing as a result of the flexing or bending of the intermediate web portion 65 which occurs when a force is applied to the clamp and flap-like members 35 and 29 respectively.

As previously described, the entire pack unit 19 which includes the flexible link member 37, the rigid clip member 35, and the flap-like members 29 may be removably retained within the slots 23 of the hub structure 13 by the end plates 39 and bolts 41 or some similar restraining means or, alternatively, the modular replacement unit comprising the clip member 35 and the fixedly attached flap-like members 29 may be removably retained on the first part-cylindrical head portion 61 of the link member 37. Still further, the first head portion 61 can be removably retained within the slot 55 while the second head portion 63 is fixedly retained within the hub slot 23; the head portion 61 can be fixedly retained within the slot 55 while the second head portion 63 is removably retained within the slot 23; or both of the head portions 61, 63 can be removably retained within the slots 55, 23, respectively. Preferably, the head portion 61, after it is slid lengthwise into the slot 55 of the clip member 35, is fixedly constrained therein by clamping or closing the clip body over head portion 61 of the link member 37, thus permanently securing same together.

The intermediate flexible web portion 65 is yieldable or bendable thereby assisting or aiding in the hinge-type pivotal motion of the pack unit 19 on the hub 13 and for ease in installing, removing and replacing the entire pack unit 19.

In FIGS. 1–3, the clip member 35 and link member 37 form an integral assembly for supporting and for mounting the fill material on the rotary hub or driver structure 13. The three basic components 29,35 and 37 are of generally equal lengths and are of a solid cross-section throughout in a plane at 90° to the rotary axis 18. With such a construction, the intermediate solid flexible web portion 65 is substantially narrower than the base or radially inner portion 45 of the clip member 35. The head 61 is connected to the base 45 midway between the side edges thereof. The base 45 projects laterally in opposite directions beyond the sides of the web portion 65.

The embodiments of FIGS. 4–9 inclusive are modifications of the present invention and are similar to the pack unit 19 of FIGS. 1–3. Accordingly in FIGS. 4–9 inclusive, reference numerals corresponding to those appearing in FIGS. 1–3 are employed to designate corresponding parts or details; and further description will be dispensed with.

Figure 4:
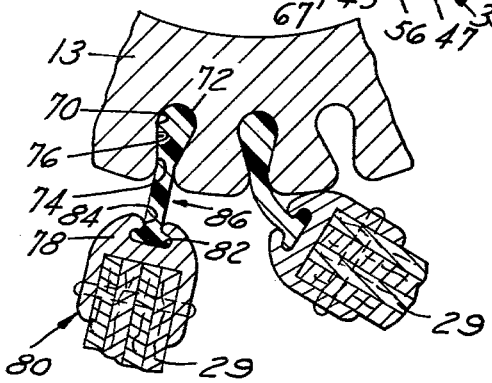
FIGS. 4–9, inclusive, are other sectional views, similar to FIG. 3, of still other pack units contemplated by the present invention.

In FIG. 4, the hub structure 13 has a plurality of slots 70 which parallel the hub axis and extend uninterruptedly throughout the axial length of the hub 13; and each slot 70 includes a cylindrical inner bore portion 72 opening radially outwardly to a circumferentially restricted or narrow outer neck or throat portion 74. The cylindrical bore portion 72 is connected to the neck or throat portion by converging flat surfaces 76.

The base 78 of the clip member 80 is provided with a slot 82 and neck 84 of different configuration than hub slot 70. The flexible link member 86 has a different shaped head at each end thereof as shown in FIG. 4 to fit and mate with the slots and necks provided in the hub 13 and clip 80. The flexible web portion of link member 86 between the heads thereof is designed to bend or flex as shown in FIG. 4.

Figure 5:
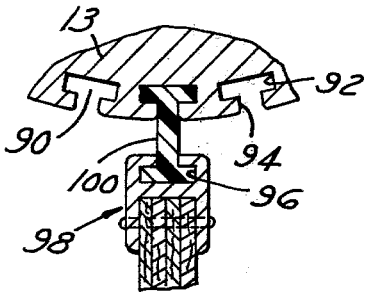

In FIG. 5, hub 13 is provided with a plurality of slots 90 of T shape configuration, including an inner elongated portion 92 and an outer neck portion 94. The slot 96 provided in the clip member 98 is identical to the shape and configuration of hub slot 90. The flexible link member 100 has T-shaped head portions at each end thereof which are received in the hub and clip member slots 90, 96 respectively.

Figure 6:
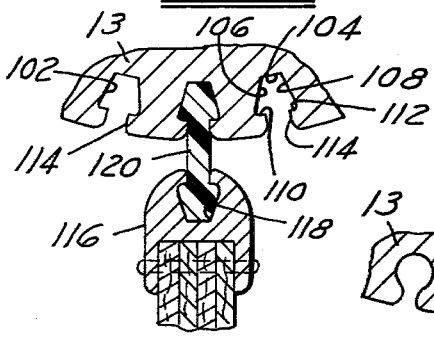

In FIG. 6, hub 13 is provided with a plurality of slots 102 having an inner surface 104, outwardly diverging surfaces 106, 108 terminating in inwardly turned surfaces 110, 112 forming shoulders. Such shoulders terminate in laterally outwardly extending surfaces forming a restricted throat or neck 114. The clip member 116 has a slot 118 in the base thereof of generally the same size, shape and configuration as hub slot 102. The flexible link member 120 has identical enlarged heads on the ends thereof shaped to mate and fit into the slots and necks of the hub 13 and clip member 116.

Figure 7:
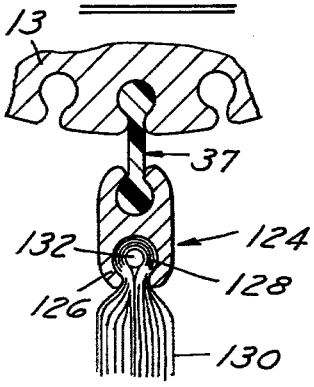

In FIG. 7, the clip member 124 has the radially outer portion 126 provided with an elongated outwardly opening slot 128 which parallels the other slot provided in the base thereof. The fill material 130, as an example, wire or cord, is wrapped around an elongated pin or bar 132 and the assembly is retained in the slot 128 by closing the outer portion 126. The link member 37 is identical to the one disclosed in FIG. 3.

Figure 8:
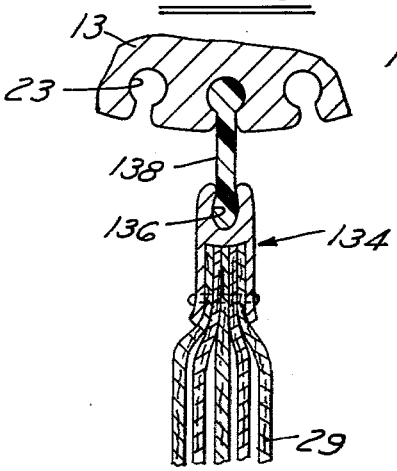

In FIG. 8, the clip member 134 has a modified slot 136. The flexible link member 138 is provided with different shaped heads to fit and mate with the slots 23 and 136 in the hub 13 and clip member 134 respectively.

Figure 9:
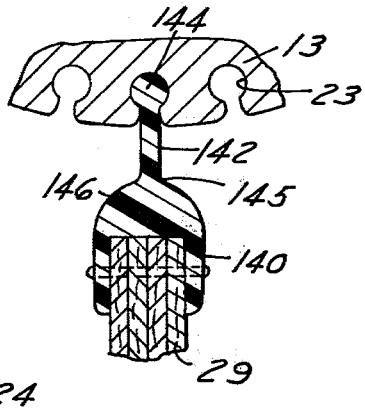

In FIG. 9, the clip body 140 and link element 142 are extruded as a single unitary component or assembly from a flexible plastic material. The combined component has only one end provided with a part-cylindrical head 144 which is received in slot 23. The root end 145 is integrally attached to the base 146 of the clip body 140 midway between the sides thereof.

Thus in FIGS. 3, 5, 6 and 7, the link members each has a pair of heads or head portions of the same or identical configuration; while in FIGS. 4 and 8, the link members each has a pair of heads or head portions of different configuration. In FIG. 9, the link member has only one head portion 144, with the root portion 145 being integrally connected to the clip portion 140 as shown.

Thus when viewed in cross-section, it should be appreciated that the shape, size and configuration of the hub and clip slots as well as the heads of the link members can vary, it being understood whatever shape, size and configuration of the slots are selected, that the same shape, size and configuration are provided on the mating heads of the corresponding link member.

In each embodiment of FIGS. 1–9 inclusive, the radial dimension of the web portion of the link member is such as to locate the latter's outer forked arms in substantially outwardly spaced relation relative to the outer periphery of the hub or hub structure 13. The web portion of each flexible link member has a width which is substantially less than the width of the base of the clip member.

In each embodiment, when the fill material or flap-like members 29 of the pack units of the finishing wheels engage the work, the flexible web portion of each pack unit appreciably flexes or bends as a result of an opposing force or forces which swings the clip and flap-like members to one or the other side of a radial plane containing the rotary axis and the hub slot axis. Once the forces are removed from the pack unit, the unit returns to its unloaded state shown in FIG. 1.

The solid flexible link member of each embodiment can bend or flex without stretching or fatiguing. Such bending occurs primarily in the narrow web portion or section of the link member. Such bending in the web section takes up the shock encountered when the pack unit is under load. Full flexing occurs in the web section of a pack unit when the unit hits or strikes an adjacent unit or the hub structure. In use the amount of flexing of the web section of a pack unit depends in part on the spacing of the pack units on the hub structure; the construction, shape and configuration of the pack units; and the forces encountered under load.

With this detailed description of the specific embodiments, it will be obvious to those skilled in the art that other modifications can be made in the structure, materials and usages recited herein without departing from the spirit and scope of the present invention which is limited only by the appended claims.

What is claimed is:

1. A pack unit comprising fill material adapted to be mounted in a position radially outwardly of the axis of a rotary driver structure, a clip member and a link member forming an assembly for supporting and so mounting said fill material on such structure, said assembly being continuously and uninterruptedly coextensive in axial length with said fill material, and in a solid cross-section throughout in a plane at 90° to said axis as thus mounted, said clip member presenting a radially outer portion of generally U-shape having a laterally extending base and having a pair of outer, generally parallel and spaced apart forked arms between which said fill material is clamped extending outwardly from the side edges of said base, said link member being made from a flexible plastic material and having radially inner and outer end portions which are separated by an intermediate solid web portion, said link member having on the radially inner end portion an axially extending and transversely enlarged head mounting portion and having said radially outer end portion connected to the base of said clip member generally midway between the side edges thereof, said web portion being substantially narrower than said base so that said base projects laterally in opposite directions beyond the sides of said web portion, said head portion and said web portion being shaped for a slidingly mating engagement with the driver structure, said flexible web portion being adapted to appreciably flex or bend when a force is applied to said clip member and fill material thus permitting said clip member and fill material to swing.

2. The pack unit defined in claim 1 wherein said clip member and said link member are formed together as a single component from an elongated length of stock of flexible plastic material.

3. The pack unit defined in claim 1 wherein said clip member and said link member are separate components joined together, with said link member component formed from an elongated length of stock of flexible plastic material.

4. The pack unit defined in claim 3 wherein said clip member component is formed from an elongated length of stock of a rigid material.

5. The pack unit defined in claim 3 wherein said radially outer end portion of said link member is provided with an axially extending and transversely enlarged head portion, the radially inner portion of the base of said clip member being provided with an elongated, radially inwardly disposed slot having an inner portion and an opened restricted neck passage, said last mentioned head portion and said web portion being telescopically received within said slot and restricted neck passage respectively in said clip member.

6. The pack unit defined in claim 1 wherein said head mounting portion is of part-cylindrical configuration for slidingly mating engagement with the rotary driver structure.

7. The pack unit defined in claim 5 wherein each of said head portions is of part-cylindrical configuration.

8. The pack unit defined in claim 5 wherein each of said head portions has the same configuration.

9. The pack unit defined in claim 5 wherein said head portions each has a different configuration.

10. The combination in a finishing wheel of a pack unit in accordance with claim 1, and a driver structure as therein referred to, said structure being provided with a plurality of like circumferentially spaced, parallel, axially extending and radially outwardly opening slots, in each of which the head mounting portion of a pack unit is slidably mounted with a substantially mating fit, said slots being substantially coextensive in overall axial dimension with the pack units, said head mounting portion of said link member being fixedly held in the slot of the driver structure while permitting said flexible web portion to flex or bend when a force is applied to the clip member and fill material.

11. The combination of claim 10, in which the radial dimension of said web portion of the link member is such as to locate the latter's outer forked arms in substantially outwardly spaced relation to said hub structure.

12. A pack unit comprising fill material to be mounted in a position radially outwardly of the axis of a rotary driver structure, and a flexible unitary clip member made from a flexible plastic material for supporting and so mounting said fill material on such structure, said clip member being continuously and uninterruptedly coextensive in axial length with said fill material, and in a solid cross-section throughout in a plane at 90° to said axis as thus mounted, said clip member presenting a radially outer portion of generally U-shape having a laterally extending base and having a pair of outer, generally parallel and spaced apart forked arms between which said fill material is clamped extending outwardly from the side edges of said base, a radially inner, axially extending and transversely enlarged head mounting portion, and an intermediate solid web portion integrally connecting said head portion and said base midway between the side edges thereof, said web portion being substantially narrower than said base so that said base projects laterally in opposite directions beyond the sides of said web portion, said head portion and said web portion being shaped for a slidingly mating engagement with the driver structure, said clip member being a component of an extruded axially elongated length of stock of flexible, plastic material, with the flexible web portion thereof being adapted to appreciably flex or bend when a force is applied to said clip member and fill material which swings said U-shape outer portion and fill material.

13. The combination in a finishing wheel of a pack unit in accordance with claim 12, and a driver structure as therein referred to, said structure being provided with a plurality of like circumferentially spaced, parallel, axially extending and radially outwardly opening slots, in each of which the head mounting portion of a pack unit is slidably mounted with a substantially mating fit, said slots being substantially coextensive in overall axial dimension with the pack units, said head mounting portion of said clip member being fixedly held in the slot of the driver structure while permitting said flexible web portion to flex or bend when a force is applied to the clip member and fill material.

14. The combination of claim 13, in which the radial dimension of said web portion is such as to locate the latter's outer forked arms in substantially outwardly spaced relation to said hub structure.

* * * * *